US007927460B2

(12) United States Patent
Sato et al.

(10) Patent No.: US 7,927,460 B2
(45) Date of Patent: Apr. 19, 2011

(54) SILVER SKIN-CONTAINING PAPER AND METHOD FOR PRODUCING THE SAME

(75) Inventors: Takanori Sato, Shimada (JP); Hiroyuki Morikawa, Shikokuchuo (JP)

(73) Assignee: Ito En, Ltd., Tokyo (JP)

( * ) Notice: Subject to any disclaimer, the term of this patent is extended or adjusted under 35 U.S.C. 154(b) by 237 days.

(21) Appl. No.: 12/038,554

(22) Filed: Feb. 27, 2008

(65) Prior Publication Data

US 2008/0245494 A1 Oct. 9, 2008

(30) Foreign Application Priority Data

Apr. 4, 2007 (JP) ..... 2007-098722

(51) Int. Cl.
*D21F 11/00* (2006.01)

(52) U.S. Cl. ..... 162/158; 162/91; 162/99; 162/189

(58) Field of Classification Search ..... 162/91, 162/99, 158, 189
See application file for complete search history.

(56) References Cited

U.S. PATENT DOCUMENTS

| | | | | |
|---|---|---|---|---|
| 3,429,771 | A * | 2/1969 | Kasser et al. | 162/82 |
| 4,562,218 | A * | 12/1985 | Fornadel et al. | 524/15 |
| 6,117,474 | A * | 9/2000 | Kamada et al. | 426/590 |

FOREIGN PATENT DOCUMENTS

| | | |
|---|---|---|
| JP | 4-82999 | 3/1992 |
| JP | 6-235198 | 8/1994 |
| JP | 6-248042 | 9/1994 |
| JP | 8-158298 | 6/1996 |
| JP | 10-248409 | 9/1998 |
| JP | 2000-128731 | 5/2000 |
| JP | 2000-139257 | 5/2000 |
| JP | 2001-858 | 1/2001 |
| JP | 2001-329483 | 11/2001 |
| JP | 2004-166526 | 6/2004 |
| JP | 2005-348642 | 12/2005 |
| JP | 2006-97187 | 4/2006 |

OTHER PUBLICATIONS

Sayaslan, Abdulvahit; Wet-milling of wheat flour: industrial processes and small-scale test methods; Aug. 2004; Elsevier Science Ltd.; Swiss Sociey of Food Science and Technology; vol. 37, Issue 5, pp. 499-515.*

* cited by examiner

*Primary Examiner* — Matthew J Daniels
*Assistant Examiner* — Jacob Thomas Minskey
(74) *Attorney, Agent, or Firm* — Oblon, Spivak, McClelland, Maier & Neustadt, L.L.P.

(57) ABSTRACT

Disclosed are silver skin-containing paper and the production method thereof. Aqueous pulp slurry containing paper pulp fibers and ground silver skin is prepared, wherein the ground silver skin is provided by wet grinding of silver skin in the presence of water. The aqueous pulp slurry is then formed into a sheet. The silver skin-containing paper contains the ground silver skin at a ratio of 5 to 60% by mass of the paper.

12 Claims, No Drawings

SILVER SKIN-CONTAINING PAPER AND METHOD FOR PRODUCING THE SAME

BACKGROUND OF THE INVENTION

1. Field of the Invention

The present invention relates to oil absorbent silver skin-containing paper having a low water absorbency and a method for producing the same, and specifically to silver skin-containing paper and a method for producing the same, wherein coffee silver skin discarded during beverage production is effectively used for paper manufacture to provide oil absorbent paper having a low water absorbency.

2. Related Art

In the preparation of beverages such as teas including green tea and black tea, coffee, and juices, fine refuse or extraction residues of tea leaves, coffee grounds, etc., are discarded as wastes. Much of coffee beans distributed for ordinary households or coffee shops are provided to the market after roasting green coffee beans in roasting plants or the like, and a great amount of coffee roasting residues are discarded from the roasting plants. Also in the tea roasting process, roasting residues and fine grounds are discarded. From the viewpoints of environmental protection and effective utilization of resources, methods for effectively utilizing these wastes have been studied.

For example, Japanese Patent Application Laid-Open (JP-A) No. 4-82999 discloses patterned paper containing coffee extraction residues or ground roasted coffee beans having an average particle size of 3 mm or less. JP-A No. 6-235198 discloses patterned paper containing tea leaves or tea grounds of, for example, black tea, green tea or oolong tea, as pattern formers. In order to solve the problems regarding the workability during sheet forming and the hardness of the material, JP-A No. 8-158298 proposes micronization of vegetable matter including stems and leaves to a size of 1 to 100 microns.

JP-A Nos. 10-248409 and 2000-128731 disclose paper mulch sheets made of paper pulp containing a carbon powder made from coffee grounds, proposing to effectively utilize adsorptivity of carbon.

Examples of other applications include an oil absorbent as disclosed in JP-A No. 2001-000858, which is made by attaching a water-repellent silica powder to coffee grounds or the like. JP-A No. 2000-139257 discloses coated particles for treating small animal wastes, wherein the coated particles are made by coating a core made of a ground product of vegetable organic fibers such as rise husk, with a superabsorbent polymer and a paper powder. Examples of the useful organic fibers include silver skin as well as peat moss, coconut fibers, tree bark, and shell and skin of peanuts.

As described above, various applications have been developed for the bean portion including coffee beans and extraction residues. On the other hand, few applications have been developed for silver skin discarded during coffee roasting, and there is inadequate utility for accepting the recycle of the wastes. Accordingly, further development of the treatment methods and applications for the wastes has been demanded.

BRIEF SUMMARY OF THE INVENTION

An object of the present invention is to develop a method for treating silver skin wherein a large amount of silver skin emitted as roasting residues during roasting green coffee beans is possibly treated and effectively utilized to provide a useful recycled product.

Another object of the present invention is to develop an application which sufficiently utilizes the inherent properties of silver skin, and to provide a recycled product which more effectively utilizes silver skin.

Another object of the present invention is to develop a method for efficiently producing, with silver skin, silver skin-containing paper having functions, making use of the characteristics of silver skin, and to provide highly useful silver skin-containing paper.

Another object of the present invention is to promote the effective utilization of silver skin whose applications have been insufficiently developed, thereby optimizing the utilization of the resource to reduce loads to the global environment.

As a result of the study by the inventors to solve the above problems, it has been found that the optimization of the condition of coffee roasting residues (silver skin) allows favorable mixing of the residues with paper pulp, thereby making possible to produce useful and highly functional paper having characteristics of the roasting residues such as oil absorbency and low water absorbency. The present invention has been accomplished as described above.

According to one aspect of the present invention, a method for producing silver skin-containing paper, comprises: preparing an aqueous pulp slurry containing paper pulp fibers and ground silver skin provided by wet grinding of silver skin in the presence of water; and forming the aqueous pulp slurry into a sheet.

Moreover, according to one aspect of the present invention, a silver skin-containing paper, comprises: pulp fibers; and ground silver skin at a ratio of 5 to 60% by mass of the silver skin-containing paper.

The ground silver skin of the paper preferably has a particle size of 106 microns to 2.8 mm, and the silver skin-containing paper provides excellent oil absorbency.

In accordance with the above construction of the present invention, it is allowed to efficiently manufacture oil absorbent paper having a low water absorbency utilizing the essential characteristics of silver skin, and to promote the utilization of wastes through the increases in the usefulness of the recycled product and the demand for that product, on the basis of the above-described functions of the paper, thereby contributing to the optimization of resource utilization and the reduction of loads to the global environment.

DETAILED DESCRIPTION OF THE INVENTION

Examples of common treating processes for coffee roasting residues include: composting in a large treatment plant; utilization as materials for domestic animals; incineration; and carbonization, etc. However, the coffee roasting residues (silver skin) are hard to handle because of their low water absorbency, which generally makes it difficult to recycle the residues. When ground coffee beans or coffee extraction residues are contained in paper as described in JP-A No. 4-82999, the ground coffee beans outcrop to the paper surface to increase the friction resistance. In addition, the amount of the ground coffee beans or coffee extraction residues that are possibly contained in the paper is small because they are poorly entangled with paper pulp fibers. Consequently, the characteristics of coffee beans are hardly utilized, and the resultant paper is so indistinctive that it is poorly demanded and insufficient to promote the use of the coffee waste. Accordingly, these methods are also hard to promote the utilization of silver skin.

Under the above-described circumstance, the inventors of the present application have focused attention on the oil absorbency of silver skin, and they have studied a method for providing oil absorbent paper having low water absorbency, produced by mixing silver skin with paper pulp.

Silver skin produced as a roasting residue during coffee roasting is a kind of membranes covering the coffee bean or endosperm. It is a contributor to astringency, being fibrous, and peels off the bean during roasting. If the removed silver skin is ground and added to paper pulp being dispersed in water, the silver skin floats on the water surface because of its low density and light weight, and it is thus hard to uniformly mix with paper pulp. In addition, silver skin contains lipophilic components and has lower water absorbency than paper pulp, that also contributes to the poor miscibility with paper pulp.

In order to solve the above problems, in the present invention, silver skin produced by roasting is used after subjecting it to wet grinding. More specifically, the silver skin is ground in the presence of water in such a manner that the load applied to the silver skin accelerates the absorption of the contacting water into the silver skin, thereby increasing the water content, so as to improve conformability of the silver skin with the aqueous slurry of paper pulp. Moreover, in contrast to grinding under dry conditions that tends to blow up dust, the wet grinding prevents dust release, thereby improving the grinding efficiency and the yield. The presence of water also suppresses thermal decomposition of the components thereof. From these facts, in the present invention, silver skin produced during the roasting process is wet-ground to make a water-containing ground product having an appropriate particle size, and the ground product is mixed with a paper pulp slurry and formed into a sheet. The present invention is further described below in detail.

Silver skin is discarded as wastes from roasting plants or the like for roasting coffee beans. Specifically, the silver skin used in the present invention includes: coffee bean outer skin (testa, epidermis: silver skin in narrow sense) that peels off the bean (endosperum) when water-washed or unwashed green coffee beans or water-washed and dried beans are roasted with a roaster; broken center cut that is emitted during milling of the roasted beans; and milled chaff or roasting byproduct that further peel off the surfaces of roasted bean. In these treatment steps from roasting to milling, the silver skin is separated and appropriately collected to use. Various kinds of coffee beans such as robusta, arabica species and the like are favorably used.

Silver skin discarded from the roasting plants or the like as coffee roasting residues is wet-ground in the presence of water using a grinding machine having breaking, cutting or crushing function, for example, a ball mill, a roll mill, a kneader or a defibrator, to prepare water-containing ground silver skin. The grinding efficiency and the water content in the ground product vary, depending on the water proportion during grinding. The ratio of water to silver skin is preferably 1/1 or more in terms of mass ratio. If the amount of water is insufficient, the particle size tends to increase because of the poor grinding efficiency, and the silver skin tends to separate from the pulp slurry because of the insufficient water content. Silver skin is preferably ground to have a particle size of about 106 microns to 2.8 mm, and it may be adjusted to have an appropriate particle size by control of the treatment conditions such as the water proportion and grinding time or by sieve classification. If the particle size of the ground product is less than 106 microns, silver skin fibers are hardly entangled with paper pulp, which results in the deterioration in strength and the difficulty of increasing the contained proportion of silver skin. If the particle size of the ground product is more than 2.8 mm, the silver skin peels off the paper product to impair the product value.

Ground silver skin having water content of about 45% by mass or more is readily mixed with paper pulp slurry. Therefore, treatment conditions including the amount of water for grinding and the grinding time are controlled so that the wet-ground silver skin has a water content of preferably 45% by mass or more, more preferably from 50 to 80% by mass. The wet grinding treatment is possibly conducted in favor of silver skin alone. If the ground and water-containing silver skin is added to aqueous pulp slurry being previously prepared, they are possibly mixed uniform and the mixture is favorably used for sheet forming.

For the paper pulp used for the preparation of the paper pulp slurry to be mixed with the ground silver skin, chemical pulp, regenerated pulp or mechanical pulp made from, for example, wood chips or waste paper are appropriately utilized. Specifically, in a case of wood chips used as the raw material, unbleached pulp obtained by cooking the wood chips, followed by delignification, and repeated washing and dewatering, and bleached pulp obtained by breaching and washing the unbleached pulp are suitably used. The unbleached or bleached pulp may also be prepared from wood chips ground by a refiner. In a case of waste paper used as the raw material, unbleached or bleached pulp made from waste paper is suitably used, wherein the unbleached pulp is obtained by defibrating the waste paper with a pulper (defibrator), followed by washing the pulp, and the bleached pulp is obtained by breaching and washing the unbleached pulp. The chemical pulp, regenerated pulp and mechanical pulp may be used alone or in combination for paper manufacture.

The paper pulp as described above is defibrated in water using a defibrator, thereby making aqueous slurry of the paper pulp. Then the ground silver skin mentioned above is added to the slurry and uniformly dispersed therein, to make pulp slurry for making silver skin-containing paper. Alternatively, the wet-ground silver skin may be fed into a paper pulp defibrator together with water and raw material paper pulp, where these components are mixed while the pulp is being defibrated to make pulp slurry. Alternatively, since it is also possible to grind the silver skin by the defibrating operation for the paper pulp, the silver skin may be wet-ground simultaneously with defibration of the paper pulp. In this case, in consideration of conformability of silver skin with water, it is preferred that paper pulp be added to moist silver skin that water is somewhat incorporated precedingly. Then the silver skin is wet-ground while being mixed with defibrated paper pulp fibers, which promotes uniform mixing of the silver skin with the pulp slurry, and prevents the ground silver skin from floating on the surface of the paper slurry.

The proportion of the silver skin is preferably from about 5 to 60% by mass in terms of dry mass in the dry product paper that is obtained after the paper slurry is formed into a sheet and dried. If the amount of the silver skin is 5% by mass or less, the oil absorbency is ineffectively exhibited because of the insufficient decrease of the water absorbency, and the effect of reducing friction is not provided. If the amount of the silver skin is more than 60% by mass, the silver skin tends to peel off the formed sheet, which results in the deterioration in the oil absorbency of the paper product. The paper pulp slurry may contain, as necessity arises, various additives useful for ordinary paper sheet forming, for example, a sizing agent; a paper strengthening agent for falling prevention, such as various synthetic resins, starch or modified starch; an inorganic pigment such as talc, calcium carbonate, silica or kaolin; and an organic filler such as an urea-formalin resin or a styrene resin; a dye; and a pigment.

An aqueous slurry mixture containing the ground silver skin prepared as described above, paper pulp fibers, water, and additives optionally used as necessity arises, is formed into a sheet. More specifically, the mixture is fed onto a net having openings of less than 500 microns, and dewatered to form in a felt-like shape while the thickness being adjusted. The formed product is further dewatered with a press machine or the like, and then dried by heating or air drying to decrease the residual water content, thereby making a sheet of paper containing ground silver skin.

The sheet of paper made according to the above procedure is silver skin-containing paper containing 5 to 60% by mass ground silver skin, and additives optionally blended as necessity arises. The silver skin-containing paper has lower water absorbency, higher oil absorbency, and a lower surface friction resistance than paper made of pulp alone. The reason for the decrease of the friction resistance is considered because the flexible fibers of silver skin are readily entangled with paper pulp fibers so that the resultant sheet is pressed to easily form a smooth surface. The silver skin-containing paper is, owing to its functions, useful for applications requiring absorbency of both of oil and water, for example, loo seat covers, paper napkins, paper towels, kitchen towels, wrapping paper and the like.

EXAMPLES

The present invention is illustrated below with reference to the following examples. However, the present invention is not limited to these examples.

Example 1

Sample Preparation

To silver skin having water content of 5% by mass, water was added in such an amount that a proportion of water to the silver skin was 3 to 1 in terms of mass ratio. The silver skin was wet-ground using a juicer mixer (JC-L80MR, manufactured by Toshiba Corporation), and sieved to give ground silver skin fractions of samples A1 to A4, having different particle sizes as listed in Table 1. The water content in the ground silver skin fractions (samples A1 to A4) was measured using an infrared aquameter (FD-620, manufactured by Kett Electric Laboratory), and found to be 75% by mass, respectively.

Another ground product was prepared in the same manner as described above, except that the silver skin was dry-ground with no addition of water, and it was classified through a 140-mesh sieve and a 6.5-mesh sieve to give ground silver skin fractions (samples B1 to B4) having different particle sizes.

In addition, coffee extraction residues after the preparation of beverage was dried for 5 hours at 105 degrees C., dry-ground, and sieve classified in the same manner as described above to give ground silver skin fractions (samples C1 to C4) having different particle sizes.

TABLE 1

| Sample Preparation | | | |
|---|---|---|---|
| Sample | | Grinding manner | Particle size |
| A1 | Silver skin | Wet grinding | More than 2.8 mm |
| A2 | Silver skin | Wet grinding | 1 mm to 2.8 mm |
| A3 | Silver skin | Wet grinding | 106 microns to 1 mm |
| A4 | Silver skin | Wet grinding | Less than 106 microns |
| B1 | Silver skin | Dry grinding | More than 2.8 mm |
| B2 | Silver skin | Dry grinding | 1 mm to 2.8 mm |

TABLE 1-continued

| Sample Preparation | | | |
|---|---|---|---|
| Sample | | Grinding manner | Particle size |
| B3 | Silver skin | Dry grinding | 106 microns to 1 mm |
| B4 | Silver skin | Dry grinding | Less than 106 microns |
| C1 | Coffee grounds | (Dry) | More than 2.8 mm |
| C2 | Coffee grounds | (Dry) | 1 mm to 2.8 mm |
| C3 | Coffee grounds | (Dry) | 106 microns to 1 mm |
| C4 | Coffee grounds | (Dry) | Less than 106 microns |

<Sheet Formability>

The influences of the ground silver skin and coffee grounds blended on making paper were examined as follows.

Paper slurry was prepared by immersing 25 g of waste plain paper of A4 size in 1,000 ml of distilled water, and stirring it for 3 minutes in a juicer mixer (JC-L80MR, manufactured by Toshiba Corporation) to thoroughly disperse the paper pulp.

The paper slurry was used for preparing aqueous slurries each containing the ground silver skin or coffee grounds at the ratio listed in Table 2 in terms of the dry mass, by mixing the paper slurry with the ground silver skin fraction or coffee grounds fraction of each of the samples A1 to A4, B1 to B4 and C1 to C4 listed in Table 1.

A 100 ml portion of each aqueous slurry was fed onto a net having a dimension of 10 cm×15 cm and having openings of 100 microns, and it was formed into a sheet, dewatered under a pressure of 2 kg/cm$^2$, and then dried under heating at 105 degrees C. to give a paper sheet. Then observation was made about whether the silver skin or coffee grounds drop off the net during sheet forming, and whether they peel off the formed sheet, and the sheet formability was evaluated on the basis of them. The results of evaluation are shown in Table 2. In Table 2, the numeral A represents that "the sheet is formable, and the silver skin or coffee grounds do not drop off the net during sheet forming, and do not peel off the formed sheet", the numeral B represents that "the sheet is formable, but the silver skin or coffee grounds drop off the net during sheet forming, or peel off the formed sheet", and the numeral C represents that "the sheet is not formable".

According to the results shown in Table 2, the comparison between the samples A1 to A4 and the samples B1 to B4 indicates that it is difficult with the dry-ground silver skin to form a sheet containing 30 to 70% by mass of silver skin, while a sheet containing the same amount of silver skin is formable with the wet-ground silver skin, and a favorable sheet with the proportion of silver skin being 10 to 60% by mass is obtained by using the wet-ground silver skin. These facts show that sheet formability is remarkably improved through the use of the wet-ground silver skin, and that the wet-ground silver skin provides better sheet formability than the coffee grounds. The reason is considered because the dry-ground silver skin floats on the surface of the pulp slurry and is hardly dispersed, and because the coffee grounds are insufficiently entangled with paper pulp fibers so that the addition of a large amount of the coffee grounds decreases the degree of entanglement of paper fibers and deteriorates the strength. The improvement in sheet formability by the use of the wet-ground silver skin is apparent at any particle size levels. In particular, favorable sheet formability is exhibited when the particle size is from 106 microns to 2.8 mm.

TABLE 2

| Evaluation of sheet formability | | | | | | | |
|---|---|---|---|---|---|---|---|
| | Proportion of ground silver skin or coffee grounds [% by mass] | | | | | | |
| Sample | 10 | 20 | 30 | 40 | 50 | 60 | 70 |
| A1 | A | A | A | A | B | C | C |
| A2 | A | A | A | A | A | A | B |
| A3 | A | A | A | A | A | A | B |
| A4 | A | A | B | B | B | B | C |
| B1 | A | B | C | C | C | C | C |
| B2 | A | B | C | C | C | C | C |
| B3 | A | B | C | C | C | C | C |
| B4 | A | B | B | B | C | C | C |
| C1 | A | B | B | C | C | C | C |
| C2 | A | A | A | B | B | C | C |
| C3 | A | A | A | B | B | C | C |
| C4 | A | A | B | B | B | B | C |

Example 2

Preparation of Silver Skin-Containing Paper

To silver skin having a water content of 5% by mass, water was added with a proportion of water to the silver skin being 3 to 1 in terms of mass ratio. The silver skin was then wet-ground using a juicer mixer (JC-L80MR, manufactured by Toshiba Corporation), and it was classified through a 140-mesh sieve and a 6.5 mesh-sieve to give ground silver skin fractions having a water content of 76% by mass and particle sizes of less than 106 microns, from 106 microns to 2.8 mm, and of more than 2.8 mm.

Each of the ground silver skin fractions was mixed with paper pulp at the proportions listed in Table 3 in terms of the dry mass of the ground silver skin in the solid matter, and stirred for 3 minutes together with distilled water in a juicer mixer (JC-L80MR, manufactured by Toshiba Corporation) to thoroughly disperse the paper pulp, thereby preparing a paper slurry having a solid content of 2.5% by mass, respectively.

A 100 ml portion of each of the paper slurry having a different content of the silver skin was fed onto a net having a dimension of 10 cm×15 cm and having openings of 100 microns, and it was formed into a sheet, dewatered under a pressure of 0.67 kg/cm$^2$, and then dried under heating at 105 degrees C. for 3 hours to give a paper sheet having a water content after drying of 5% by mass.

<Preparation of Coffee Grounds-Containing Paper>

Water was added to dry coffee grounds at a proportion of water to the dry coffee grounds being 3 to 1 in terms of mass ratio. The coffee grounds were wet-ground using a juicer mixer (JC-L80MR, manufactured by Toshiba Corporation), thereby preparing coffee grounds having a particle size of from 106 microns to 2.8 mm.

The coffee grounds were mixed with paper pulp at the proportions listed in Table 3 in terms of the dry mass of the pulverized coffee grounds with reference to the solid content, and stirred for 3 minutes together with distilled water in a juicer mixer (manufactured by Toshiba Corporation, JC-L80MR) to thoroughly disperse the paper pulp, thereby preparing paper slurry having a solid content of 2.5% by mass, respectively.

A 100 ml portion of each of the paper slurries having a different content of the pulverized coffee grounds was fed onto a net having a dimension of 10 cm×15 cm and having openings of 100 microns, and it was formed into a sheet, dewatered under a pressure of 0.67 kg/cm$^2$, and then dried under heating at 105 degrees C. for 3 hours to give a paper sheet having a water content after drying of 5% by mass.

<Paper Friction>

Each of the paper sheets was mounted on the sample stage of a friction tester (KES-SE, manufactured by Kato Tech Co., Ltd.), and a friction block was placed on the sheet to apply a static frictional load of 50 gf (this corresponds to an average load given to the object by touching it with a human finger) to it. In that state, the sample stage was horizontally moved back and forth over a distance of 3 cm at a rate of 1 mm/second by a synchronous motor, and the dynamical frictional force was measured at this time, thereby evaluating the friction resistance on the paper surface. The results are shown in Table 3. Here, it is noted that the sheet formability shown in Table 3 was evaluated on the basis of the observation during sheet formation in the same manner as Example 2.

According to Table 3, the sheets containing 5 to 60% by mass of the wet-ground silver skin were favorably formed. In the case of blending the coffee grounds, the paper surface is more roughened to increase in the friction resistance as the increase of the addition amount. On the other hand, in the case of blending the ground silver skin, the friction resistance decreased as the increase of the addition amount. Accordingly, it is apparent that the addition of the ground silver skin allows manufacture of paper having higher smooth surfaces. In particular, when the ground silver skin is added at a ratio of about 30% by mass or more, the friction resistance is decreased to about half the value of the paper containing pulp alone.

TABLE 3

| Friction test | | | | |
|---|---|---|---|---|
| | Silver skin-containing Paper (106 microns to 2.8 mm) | | Coffee grounds-containing Paper (106 microns to 2.8 mm) | |
| Content (by mass) | Sheet formability | Friction resistance | Sheet formability | Friction resistance |
| 0% | A | 0.0157 | A | 0.0157 |
| 5% | A | 0.0145 | A | 0.0162 |
| 10% | A | 0.0126 | A | 0.0166 |
| 20% | A | 0.0106 | A | 0.0167 |
| 30% | A | 0.0085 | A | 0.0180 |
| 40% | A | 0.0081 | B | — |
| 50% | A | 0.0080 | B | — |
| 60% | A | 0.0075 | C | — |
| 70% | B | — | C | — |
| | Silver skin-containing Paper (more than 2.8 mm) | | Silver skin-containing Paper (less than 106 microns) | |
| Content (by mass) | Sheet formability | Friction resistance | Sheet formability | Friction resistance |
| 0% | A | 0.0157 | A | 0.0157 |
| 5% | A | 0.0145 | A | 0.0140 |
| 10% | A | 0.0141 | A | 0.0115 |
| 20% | A | 0.0148 | A | 0.0091 |
| 30% | A | 0.0152 | B | — |
| 40% | A | 0.0161 | B | — |
| 50% | B | — | B | — |
| 60% | C | — | B | — |
| 70% | C | — | C | — |

Example 3

Silver skin-containing paper and coffee grounds-containing paper, each containing the ground silver skin or pulverized coffee grounds at the proportion listed in Table 4, were prepared in the same manner as Example 2, and they were dried so as to give a water content after drying of about 5% by mass in the paper. The sheets of paper were subjected to the following water absorbency test and oil absorption test.

<Water Absorbency Test>

A sheet of the silver skin-containing paper or coffee grounds-containing paper was cut into a 3 cm×3 cm strip, and the strip was immersed in distilled water for 1 hour. The strip was then taken out of the water, shaking water drops from it. The water absorption ratio (%) was determined from the mass change before and after the immersion of strip, according to the following formula 1 (Wa: mass of strip before immersion, Wa': mass of strip after immersion). If the contained material was found to fall out of the strip, the water after immersion was passed through a sieve having openings of 106 microns to recover the fallen contained material, and the total mass of the fallen material and the strip was measured for determining the water absorption ratio. The results are shown in Table 4. Here, the numeral A in Table 4 represents that "the sheet has a lower water absorption ratio than paper containing pulp alone, and causes no falling of the contained material", B represents that "the sheet has a low water absorption ratio, but causes falling of the contained material", and C represents that "the water absorption ratio of the sheet is not low".

$$\text{Water absorption ratio (\%)}=100\times(Wa'-Wa)/Wa \quad \text{(Formula 1)}$$

<Oil Absorption Test>

A sheet of the silver skin-containing paper or coffee grounds-containing paper was cut into a 3 cm×3 cm strip, and the strip was immersed in edible rapeseed oil (manufactured by Honen Corporation) for 1 hour. The strip was then taken out of the oil, shaking oil drops from the strip. The oil absorption ratio (%) was determined from the mass change before and after the immersion of strip, according to the following formula 2 (Wo: mass of strip before immersion, Wo': mass of strip after immersion). If the contained material was found to fall out of the strip, the oil after immersion was passed through a sieve having openings of 106 microns to recover the fallen material. The total mass of the fallen contained material and the strip was measured for determining the oil absorption ratio. The results are shown in Table 4. Here, the numeral A in Table 4 represents that "the sheet has a higher oil absorption ratio than paper containing pulp alone, and causes no falling of the contained material", B represents that "the sheet has a high oil absorption ratio, but causes falling of the contained material", and C represents that "the oil absorption ratio of the sheet is not low".

$$\text{Oil absorption ratio (\%)}=100\times(Wo'-Wo)/Wo \quad \text{(Formula 2)}$$

<Evaluation of Water Absorbency and Oil Absorbency>

In either case of the silver skin and coffee grounds, it is found that mixing thereof into paper pulp decreases the water absorbency and increases the oil absorbency of the resultant sheet. However, the coffee grounds cannot sufficiently decrease the water absorbency or increase the oil absorbency because increase in the content thereof is difficult due to falling out of the formed sheet. In contrast, the silver skin hardly falls out of the formed sheet and more effectively decreases the water absorbency and increases the oil absorbency than the coffee grounds. From the viewpoint of the functions, the content of the silver skin contained in the sheet is appropriately regarded as being from 5 to 60% by mass.

TABLE 4

Water absorbency and oil absorbency

| Content | Silver skin-containing Paper Absorption ratio | | Silver skin-containing Paper Absorption ratio | |
|---|---|---|---|---|
| (by mass) | water | oil | water | oil |
| 0% | 76.6 | 52.9 | 76.6 | 52.9 |
| 3% | C 76.6 | A 54.8 | C 76.7 | C 52.8 |
| 5% | A 76.4 | A 54.9 | C 77.0 | B 53.5 |
| 10% | A 74.7 | A 55.1 | C 77.3 | B 53.9 |
| 15% | A 74.3 | A 56.1 | B 76.2 | B 53.9 |
| 20% | A 74.0 | A 55.7 | B 74.8 | B 54.2 |
| 30% | A 72.6 | A 55.8 | B 73.6 | B 54.1 |
| 40% | A 72.0 | A 65.2 | — | — |
| 50% | A 69.8 | A 53.9 | — | — |
| 60% | A 67.9 | A 53.9 | — | — |
| 70% | A 57.3 | C 49.9 | — | — |

Example 4

Preparation of Pulp Slurry

In a juicer mixer (JC-L80MR, manufactured by Toshiba Corporation), 25 g of waste plain paper of A4 size was immersed in 1,000 ml of distilled water and stirred for 3 minutes to thoroughly disperse the paper pulp, thereby preparing a pulp slurry.

<Preparation of Pulp Slurry Using Dry Silver Skin>

In a juicer mixer, a 500 ml portion of the pulp slurry prepared above was placed, and 2.5 g of the silver skin having a water content of 5% by mass that was collected during the roasting process was added thereto. The mixture was stirred for 3 minutes in the juicer mixer, and distilled water was added to the mixture to adjust the solid content to 2.5% by mass, thereby preparing a silver skin-containing slurry of the sample SA.

<Preparation of Pulp Slurry Using Wet-Ground Silver Skin>

Silver skin (water content: 5% by mass) was collected during the roasting process, and water was added to 2.5 g of the silver skin to adjust the proportion of water to silver skin to 0.25/1 to 3/1 for each of samples SB to SF, according to Table 5. The silver skin was then wet-ground using a juicer mixer (JC-L80MR, manufactured by Toshiba Corporation), thereby preparing ground silver skin. The water content in the ground silver skin was measured using an infrared aquameter (FD-620, manufactured by Kett Electric Laboratory). The results are shown in Table 5.

For each sample, a 500 ml portion of the pulp slurry prepared above was added to the ground silver skin, and the mixture was stirred for 3 minutes in a juicer mixer, respectively. Distilled water was added to the mixture to adjust the solid content to 2.5% by mass, thereby preparing silver skin-containing slurries of each of samples SB to SF.

<Grinding Residue in Slurry>

For each of samples SA to SF, adjusting the concentration of the silver skin-containing slurry by addition of distilled water, a 1,000 ml portion of the silver skin-containing slurry (solid content: 1.5% by mass) was passed through a sieve having openings of 1 mm. The 1 mm plus sieve or the unpassable matter that did not pass through the sieve was dried at 105 degrees C., and its mass was measured. Using the amount of unpassable matter having a size of 1 mm or more as an index of the amount of insufficiently ground particles, a grinding residual ratio (represented as the proportion of particles having a size of 1 mm or more contained in 15 g of the total solid matter) was calculated, according to the following formula 3. The results are shown in Table 5. Here, it should be noted that the reason why the amount of unpassable matter having a size of 1 mm or more is used as the index is that the changes in the value are emphasized more apparently than those given by using the amount of matter of 2.8 mm or more as being unpassable. In other words, the use of the index described above shall not deny the effectiveness of the silver skin having a particle size of 1 to 2.8 mm that is supported by the results shown in Table 2.

$$\text{Grinding residual ratio (\%)} = (\text{Mass of unpassable matter}/15) \times 100 \quad \text{(Formula 3)}$$

<Effectiveness of Wet Grinding>

During the preparation of the pulp slurries of the samples SA, SB and SC, the silver skin adhered to the wall of the stirrer to impair the efficiency of grinding. According to the results in Table 5, the calculated values of the grinding residual ratio indicate that the grinding efficiency is improved by grinding in the presence of an appropriate amount of water, and large particles not passing through the sieve decrease. It is also evident that the water content in the ground silver skin is varied depending on the water consumption during wet grinding. The results in Table 5 show that the ratio of water to silver skin during wet grinding is preferably 1/1 or more, and such preferable water ratio gives ground silver skin having a water content of about 45% by mass or more and a grinding residual ratio of 10% or less. These facts indicate that wet grinding in the presence of an appropriate amount of water prevents the inclusion of unground or large particles of silver skin in the sheet.

TABLE 5

Effectiveness of wet grinding

| Sample | Mass ratio of Water for grinding Water/silver skin | Water content in ground product (% by mass) | Grinding residual ratio (%) |
|---|---|---|---|
| SA | — | (5) | 30.5 |
| SB | 0.25/1 | 18 | 29.1 |
| SC | 0.5/1 | 32 | 15.2 |
| SD | 1/1 | 49 | 7.5 |
| SE | 2/1 | 67 | 5.2 |
| SF | 3/1 | 74 | 1.5 |

It must be understood that the invention is in no way limited to the above embodiments and that many changes may be brought about therein without departing from the scope of the invention as defined by the appended claims.

What is claimed is:

1. A method for producing silver skin-containing paper comprising silver skin in oil absorbency-increasing amounts of 5-60% by mass of the silver skin-containing paper, which method comprises:

preparing an aqueous pulp slurry comprising paper pulp fibers and ground silver skin provided at a water content by mass of 45% to 80% by wet grinding of silver skin in the presence of water; and forming the aqueous pulp slurry into a sheet.

2. The production method of claim 1, wherein the water at the wet grinding is present at a ratio of 1/1 by mass or more to the silver skin.

3. The production method of claim 1, wherein the ground silver skin at the preparing has a particle size of 106 microns to 2.8 mm.

4. The production method of claim 3, wherein the ground silver skin at the preparing contains water at a content of from 50 to 80% by mass.

5. The production method of claim 1, wherein the silver skin comprises outer skin including testa and epidermis, separated from coffee bean during roasting coffee beans.

6. The production method of claim 5, wherein the silver skin comprises at least one of: center cut separated from coffee bean during milling the roasted coffee beans; and chaff separated from the surface of the roasted bean.

7. The production method of claim 6, wherein the silver skin comprises center cut separated from coffee bean during milling the roasted coffee beans.

8. The production method of claim 6, wherein the silver skin comprises chaff separated from the surface of the roasted bean.

9. The production method of claim 1, wherein the preparing an aqueous pulp slurry comprises one of:

defibrating paper pulp in water in the presence of the ground silver skin; and mixing the ground silver skin with aqueous slurry of paper pulp.

10. The production method of claim 9, wherein the preparing an aqueous pulp slurry comprises defibrating paper pulp in water in the presence of the ground silver skin.

11. The production method of claim 9, wherein the preparing an aqueous pulp slurry comprises mixing the ground silver skin with aqueous slurry of paper pulp.

12. The production method of claim 1, wherein the preparing of an aqueous pulp slurry comprises:

defibrating paper pulp in water concurrently with the wet-grinding of the silver skin.

* * * * *